United States Patent [19]

Buszkiewicz et al.

[11] 4,156,965

[45] Jun. 5, 1979

[54] SEMI-AUTOMATIC CONTACT INSERTION TOOL

[75] Inventors: Bruno C. Buszkiewicz, Chicago; Joseph A. Storcel, North Riverside, both of Ill.

[73] Assignee: Bunker Ramo Corporation, Oak Brook, Ill.

[21] Appl. No.: 868,945

[22] Filed: Jan. 12, 1978

Related U.S. Application Data

[63] Continuation of Ser. No. 722,674, Sep. 13, 1976, abandoned.

[51] Int. Cl.[2] ..... H01R 43/00

[52] U.S. Cl. ..... 29/754; 29/234; 29/235; 29/747; 29/760

[58] Field of Search ..... 29/747, 748, 752, 754, 29/760, 234, 235, 450

[56] References Cited

U.S. PATENT DOCUMENTS

| | | | |
|---|---|---|---|
| 3,672,024 | 6/1972 | Barr | 29/764 |
| 3,955,414 | 5/1976 | Anderson | 29/747 |

*Primary Examiner*—Carl E. Hall

*Attorney, Agent, or Firm*—William Lohff; F. M. Arbuckle

[57] ABSTRACT

Apparatus is shown for use in loading contacts in contact receiving bores of a resilient insert body. The insert body is provided with internal shoulders and bores forming restrictive passages for holding the contacts and for holding wires attached to the contacts. The apparatus includes an adapter associated with a breech loading assembly for accepting and holding the insert body. An assembly including a bullet within a barrel is pushed into the insert body to gently enlarge the shoulders and the bores. The bullet is then retracted to a stop position, leaving the barrel in place in the bore. The breech lock is then opened and contacts are loaded by hand, or other means, into the bore to the stop position. The barrel is then retracted from the bore permitting the internal shoulders of the resilient insert body to expand and grip the contacts. Thereafter, the resilient insert body, with its contacts and appropriate leads in place, is removed from the apparatus.

14 Claims, 7 Drawing Figures

SEMI-AUTOMATIC CONTACT INSERTION TOOL

This is a continuation, of application Ser. No. 722,674, filed Sep. 13, 1976 now abandoned.

BACKGROUND OF THE INVENTION

1. Field of the Invention

The present invention relates to the manufacture of electrical connectors. It particularly relates to the provision of semi-automatic apparatus for use in inserting contacts into resilient insert connector bodies.

2. Summary of the Prior Art

Some prior art machines for use in loading contacts into resilient connector bodies or shells include devices which force the contacts into the shells. Such devices have not included opening means for gently opening the internal bores of the connector shell, extracting a part of the opening means, inserting a contact and then removing the remainder of the opening means gently to avoid harm to the connector. It is apparent, therefore, that these prior art devices are not such as to work well with certain connectors and connector shells which require gentle treatment.

Other prior art machines are known which include apparatus of use to expand the internal bores of connector shells. Contacts are inserted then in the expanded bores and the expansion apparatus is removed, allowing the internal walls of the bores to contract and hold the contacts. These prior art machines generally have not included means enabling quick insertion and removal of connector shells, rapid expansion of bores in the shells under control of an operator, nor ready insertion of contacts by application of near zero insertion forces. They do not appear to involve apparatus such as a breech lock to support adapters which retain connector shells while contacts are inserted.

SUMMARY OF THE INVENTION

In view of the foregoing, it is a primary object of the invention to provide an improved machine or apparatus for use in inserting contacts into contact receiving bores in resilient connector bodies. It is a further object to provide an improved contact insert apparatus or tool to enable the insertion of contacts in resilient connector bodies without damage to the contacts or to the bodies or to internal shoulders, restricted passages or seals in said bodies. It is yet another object to provide an improved contact insert tool which is operable by means of air pressure which enables speedy and efficient operation of the tool. It is still a further object to provide means enabling an operator to quickly and reliably install contacts in a resilient connector body by use of near zero insertion force and with minimal fatigue.

To attain the foregoing objects and others ancillary thereto, a contact loading machine according to the present invention is provided to enable contact receiving bores in resilient connector bodies to receive and retain contacts and wires attached to the contacts. The machine includes a housing and a breech loading assembly for receiving and holding the connector body. To load the machine, or position a resilient connector body in the machine, the breech loading assembly is pivoted sideways to expose a first adapter in the housing and a second adapter in the breech loading mechanism. A resilient connector body is then placed in the first adapter and the breech loading assembly is pivoted back in place to secure the connector body between the first and second adapters. A first plunger or piston of a dual-piston device is provided within the housing to support a bullet shaped insert device and a second plunger or piston which is coaxial with the first and outside the first is provided within the housing to support a sleeve, or barrel, in a position outside the bullet and coaxial therewith. The pistons or plungers are controlled by air pressure and are used by an operator to push the bullet and barrel, the bullet having its pointed end first, into a bore in the resilient connector body to gently enlarge the bore. A spring is released when a lever reaches a predetermined position to activate the first plunger and retract the bullet to a stop position, leaving the barrel in the bore. The breech loading assembly is then pivoted sideways again, exposing the end of the resilient connector body with the sleeves inside exposed. A contact may then be pushed within the bore, by hand or other means, to the stop position. Air pressure is then used to activate the second plunger and retract the barrel from the bore, releasing the internal shoulders and permitting them to grip the contact. The connector body, complete with contacts, may then be removed from the machine.

BRIEF DESCRIPTION OF THE DRAWINGS

The above mentioned and other features and objects of this invention and the manner of obtaining them will become more apparent, and the invention itself will be best understood by reference to the following description of an embodiment of the invention taken in conjunction with the accompanying drawings, in which.

DESCRIPTION OF PREFERRED EMBODIMENTS

Figure 1:
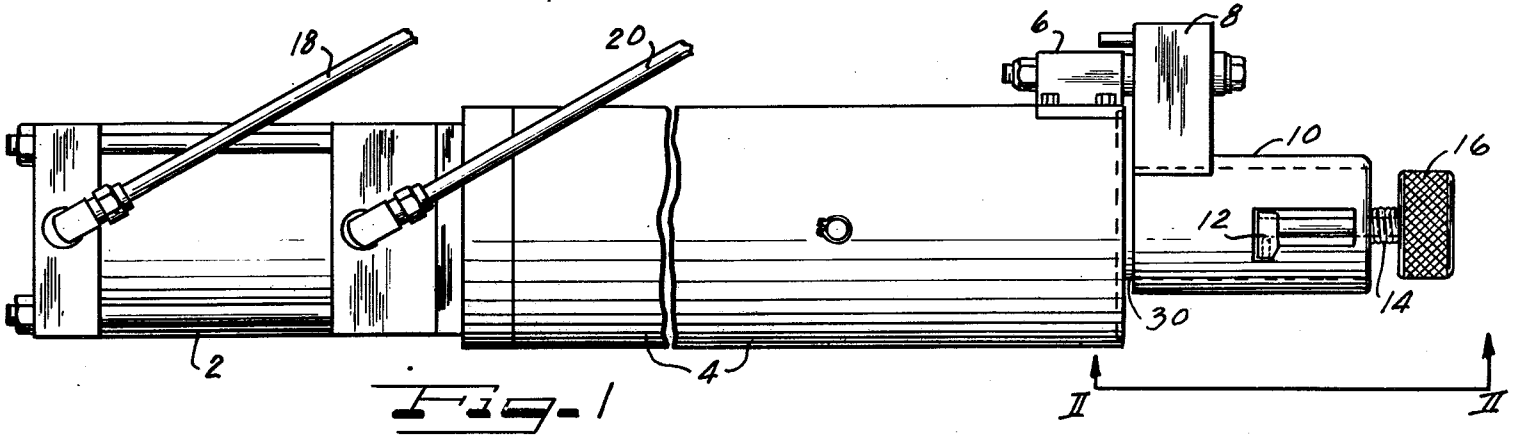
FIG. 1 is a view in elevation of a machine in accordance with the invention.

Turn to FIG. 1 for a view in elevation of a machine in accordance with the invention. In this view, an air cylinder is indicated at 2 in association with a housing 4 and a breech lock mechanism including a bracket 6, arm 8, cylinder 10, latch 12, spring 14 and handle 16.

The air cylinder 2 is shown to have two external connections 18, 20 which connect to a valve (not shown) which may be controlled by an operator's foot or other means and which controls the flow of air under pressure to opposite sides of a piston (not shown) in the cylinder. The air supplied through 18,20 is used to drive the piston in a selected direction in the cylinder. As will be clearer from the further description, movement of the piston is used to drive mechanisms in the housing 4 to desired positions to open and close the bores in a connector, enabling the bores to be expanded to receive contacts without the use of force and subsequently to be contracted to secure the contacts in place.

Figure 3:
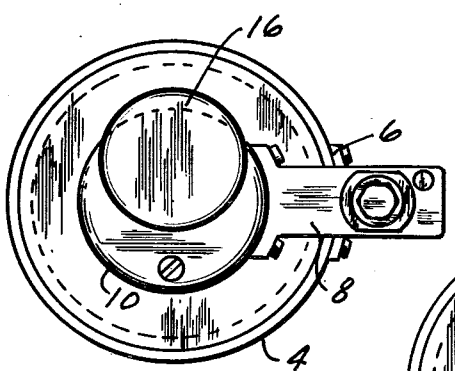
FIG. 3 is an end view of the embodiment of FIG. 2, in its closed state.
Figure 2:
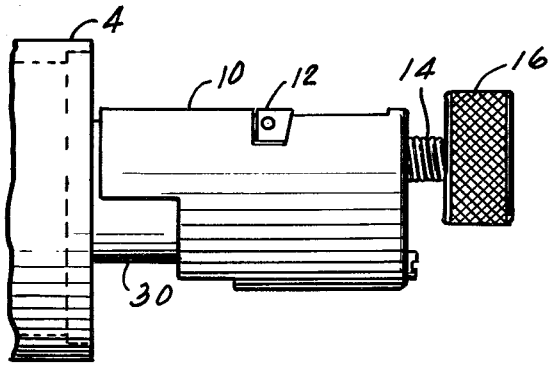
FIG. 2 is a side view of a portion of the embodiment of FIG. 1, taken along line 2—2, showing an external view of the breech lock mechanism.

The breech lock mechanism is shown in FIGS. 1, 2, 3 in a position enabling it to retain a portion of a connector in juxtaposition to the housing 4 while the air controlled mechanism in the housing 4 is operated to penetrate bores internal to the connector. Subsequently, the breech lock may be released from the position illustrated in FIG. 3 and moved to the open position shown in FIG. 4 permitting access to the connector so that contacts may be inserted with zero insertion force to a stop point in the connector. After the contacts have been placed, operation of the air cylinder to its alternative position will cause inserts in the bores to be removed and the contacts, with any associated electrical wiring, to be secured by the connector.

FIG. 2 is a side view of a portion of the apparatus of FIG. 1, taken along line 2—2, showing an external view of the breech lock mechanism 10, 12, 14, 16 in its closed state. In this view, portions of a fixed adapter plug connector 30 and the housing 4 are shown.

FIG. 3 is an end view of the disclosure of FIG. 2 showing further details of the breech lock assembly in its closed condition.

Figure 4:
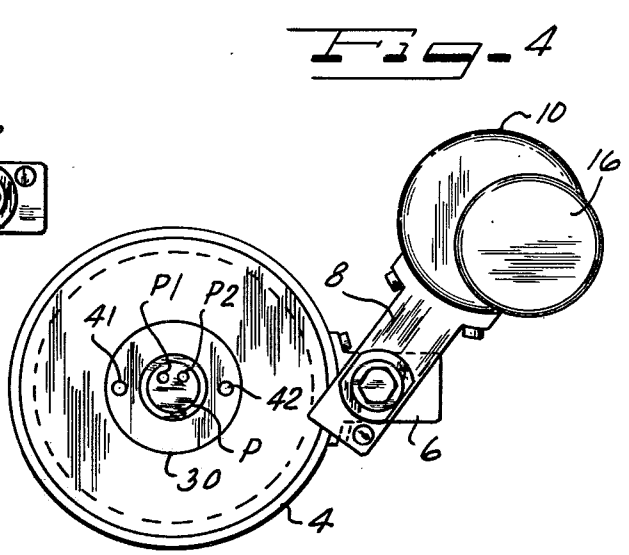
FIG. 4 is an end view of the embodiment of FIG. 2 illustrating the breech lock assembly in its opened state.

FIG. 4 is an end view of the disclosure of FIG. 2 showing the breech lock assembly in its opened state. The opened state has been achieved by turning the handle 16 clockwise to disengage the latch 12, moving a sliding adapter plug 40 (FIG. 5) fully into the breech lock and turning the breech lock assembly clockwise into the position shown in FIG. 4. In this view, the end of the fixed adapter plug connector 30 is indicated. The sliding adapter 40, as shown elsewhere in this disclosure, is mated to the fixed adapter 30 when the breech lock is closed and provides a receptacle for a plug connector P to secure P at the time when the air controlled mechanism is pressed into P. The circles at P1, P2 in the plug P designate openings available to receive contacts and wiring to the contacts. The circles 41, 42 in the fixed adapter 30 designate holes which receive alignment pins of the sliding adapter 40.

Figure 5:
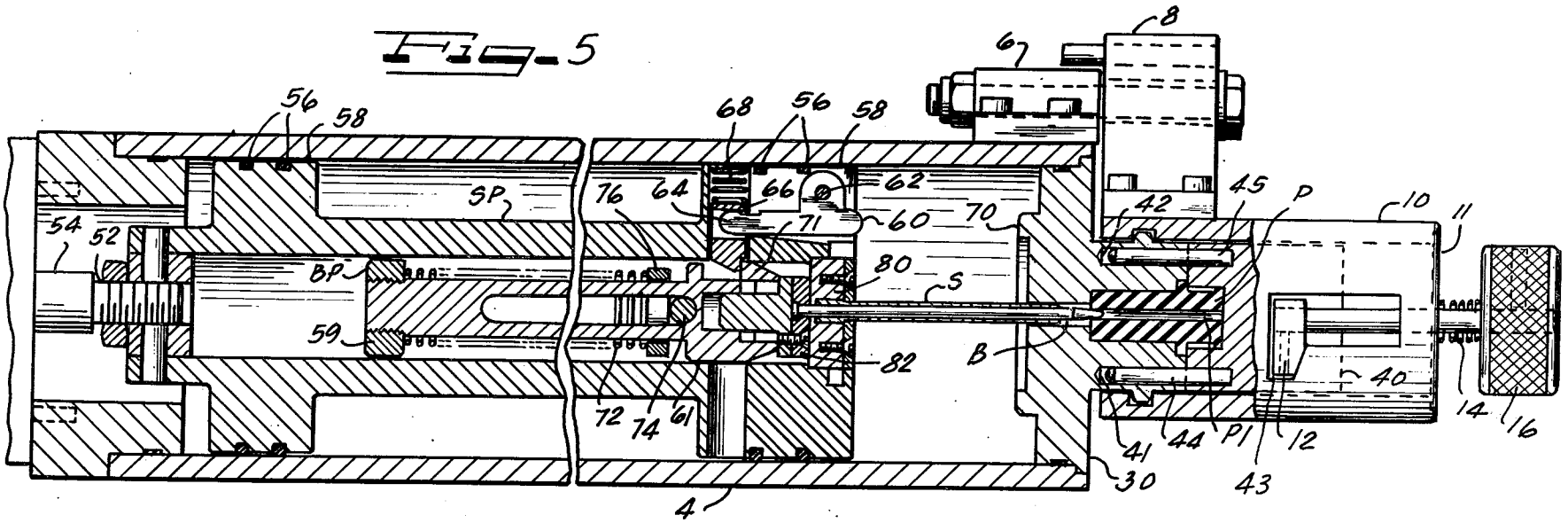
FIG. 5 is a sectional view of an embodiment of the invention according to FIG. 1.

FIG. 5 is a sectional view of a portion of the apparatus corresponding to the view shown in FIG. 1. In this view, a sleeve plunger SP and a bullet plunger BP are shown positioned to share a common axis within the walls of the housing 4. The sleeve plunger SP is coupled by coupling means 52, 54 to the air cylinder 2 so that air to the air cylinder, as controlled by an operator, can be used in the control of SP and also BP.

The sleeve plunger SP is supported within the walls of the housing 4 by suitable lubricated troughs indicated at 56 between faces at 58 of the piston. This enables the sleeve plunger to move back and forth within the housing wall. The bullet plunger is supported within internal walls of the sleeve plunger by retainers at 59, 61 which makes it possible for the bullet plunger to move back and forth within the walls of the sleeve plunger.

The sleeve plunger SP supports a sleeve, or tube, S. The bullet plunger BP supports a contact positioning pin or bullet B. As shown in FIG. 5, when the system is at rest, the bullet B is positioned within the sleeve S. When air is supplied to the air cylinder 2 in a manner which drives the sleeve cylinder towards the right, the bullet plunger also is driven to the right by interaction between a pawl 66 which is carried by SP and the section 71 on the bullet plunger BP. As a result of this cooperative action, the bullet and sleeve will be carried to the right where they will penetrate into bores P1 in a connector plug P positioned in the fixed plug connector adapter 30.

Immediately after the sleeve and plunger penetrate into the bore of a plug P in the fixed plug connector adapter, the plunger BP is returned to its original position due to interaction as follows. In this connection it should be noted that the plunger SP includes lever means at 60 which is pivoted about a dowel pin at 62 so that an arm at 64 presses against a pawl 66 which is biased in the position shown by a spring 68. The lever 60 is arranged so that when the system is energized to force the sleeve plunger SP to the right, the lever will strike the face 70 of a fixed plug connector adapter 30 causing 60 to rotate about the dowel pin at 62 and press the pawl 66 upward against the action of the spring 68. This in turn will cause the lower portion of the pawl 66 to disengage the lip 71 of the plunger BP thereby releasing the plunger BP. It will be seen that the plunger BP is associated with a spring 72 which is captive between retainer means 59 and a washer at 76. The washer 76 rides against the fixed stop 74 so that the spring is compressed as the plunger BP moves to the right and therefore is able to move BP to the left when the latch between pawl 66 and section 71 of BP is released.

The sleeve, or tube, S remains in the bore of the plug after the bullet plunger BP has been returned to the position shown in FIG. 5. The sleeve in this way provides an opening in the bore P1 of the plug P into which a contact may be inserted to a stop point determined by the tip of the bullet B.

To prepare the apparatus so that the bore of the plug is accessible to receive contacts, the breech lock is opened by rotating the handle 16 clockwise, pulling it against the spring 14. This releases the sliding plug connector adapter 40, since the breech lock latch 12, which is seated in the slot 43 of the sliding adapter 40, pulls alignment pins 44, 45 out of the alignment holes 41, 42 in the fixed adapter 30 to pull the sliding adapter from the fixed adapter. The breech block, with the sliding adapter, can then be rotated to the position shown in FIG. 4. With the breech block out of the way, bores such as P1, P2 will be exposed and contacts, with electrical leads attached, may be placed in the bores by hand with the application of virtually no force. A convenient stop point against which the contacts may be lodged is presented by the tip of the bullet, or bullets B.

Figure 6:
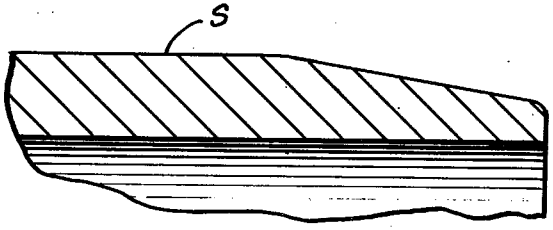
FIG. 6 is a sectional view showing a taper characteristic of the end of the barrel.

A preferred configuration for the tip of the sleeve S is shown in FIG. 6. This arrangement has been selected to provide ready access into the bore of a plug while minimizing the force applied to the plug and therefore the risk of damage to the plug.

After the contacts have been installed, the operator can retract the sleeve plunger SP and sleeve S by pressing a foot lever or other device (not shown) to energize the air cylinder 2. After the sleeve S has been retracted the bore will contract to capture the contacts and hold them securely. The resilient insert plug can then be extracted from the fixed plug connector adapter 30.

The fixed adapter 30 and sliding adapter 40 fit together as a pair. A particular pair will be used with two contact plugs and different pairs will be used with 3 contact plugs, 5 contact plugs etc.

Figure 7:
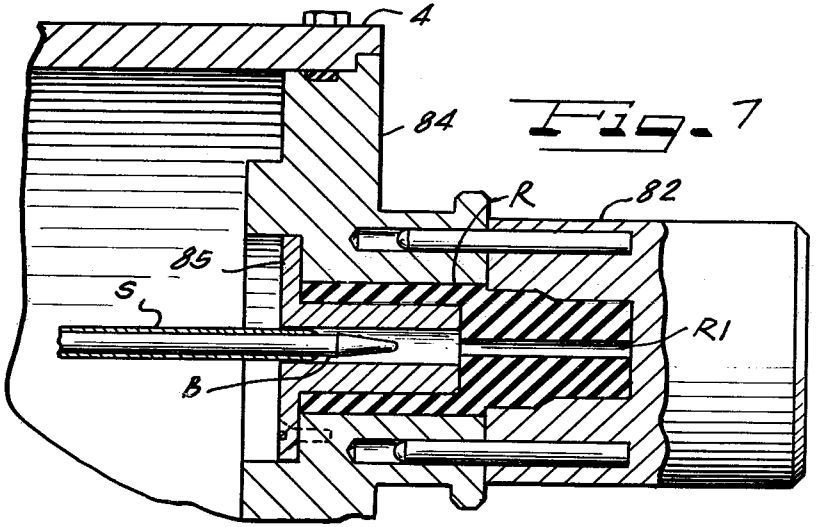
FIG. 7 is a sectional view of a portion of the apparatus of FIG. 5 in which apparatus to retain a receptacle has been substituted for the apparatus to retain a plug.

The illustrated fixed adapter 30 and sliding adapter 40 of FIG. 5 are designed for use in the assembly of contacts into the plug-halves of connectors. Adapters of slightly different form, as indicated in FIG. 7, will be used for the receptacle-halves. Sleeves S and bullets B and their supporting elements at 80, 82 may also have to be replaced to compensate for different travel lengths as well as the requirement to penetrate different numbers of bores. It will be seen in FIG. 7 that a fixed receptacle connector adapter is indicated at 84, 85 which mates with a sliding receptacle connector adapter at 82 to retain a receptacle R. Appropriate bullets and sleeves indicated at B and S will be used to expand the bore or bores R1 in the receptacle connector R.

While the principles of the invention have been described above in connection with specific apparatus and applications, it is to be understood that this description is made only by way of example and not as a limitation on the scope of the invention.

I claim:

1. A machine for use in loading contacts into contact receiving bores of a connector body comprising adapter means for receiving and retaining a connector body having a contact receiving bore, locking means for securing a connector body in the adapter means, bore enlarging means including a body and a shell, first piston means for supporting said body, second piston means for supporting said shell, said first and second piston means cooperating for aligning said body coaxially within said shell and for simultaneously pushing said body and said shell into a contact receiving bore for gently enlarging the bore, said first piston means being slidably mounted within said second piston means for retracting said body from said shell while leaving said shell in the bore in a position to receive a contact in the bore, and said second piston means being arranged for retracting said shell from the bore.

2. The invention as claimed in claim 1, in which said body is bullet shaped having a pointed end to gradually enlarge a bore, and wherein said shell is tube shaped having a tapered end for aiding said body in gradually enlarging a bore.

3. A machine for use in loading contacts into contact receiving bores of a connector body comprising:

adapter means for receiving and retaining a connector body having a contact receiving bore;

bore enlarging means including a body and a shell;

first control means for supporting said body;

second control means for supporting said shell;

said first and second control means cooperating for aligning said body coaxially within said shell and for simultaneously pushing said body and said shell into a contact receiving bore for gently enlarging the bore, said first control means being arranged for retracting said body from said shell while leaving said shell in the bore in a position to receive a contact in the bore;

said second control means being arranged for retracting said shell from the bore; and locking means for securing a connector body in said adapter means, said locking means including a breech lock, said breech lock being positionally adjustable between a first position in which it may be latched for securing a connector in place in said adapter while said bore enlarging means are installed, and a second position for rendering the connector accessible to the implantation of contacts and contact wires therein.

4. The invention as claimed in claim 1 further comprising a fixed body, latching means for latching said first piston and said second piston together, biasing means for connecting said first piston to said fixed body, said biasing means being arranged for urging said first piston in the opposite direction to the direction of travel of said first and second pistons as said pistons push said body and shell into a contact receiving bore, and means responsive to travel of said first piston beyond a limit to release said latching means, whereby said first piston is forced to move in the opposite direction and retract said body from the bore.

5. A machine for use in loading contacts into contact receiving bores of a connector body comprising:

adapter means for receiving and retaining a connector body having a contact receiving bore;

bore enlarging means including a body and a shell;

first piston means for supporting said body;

second piston means for supporting said shell;

said first and second piston means cooperating for aligning said body coaxially within said shell and for simultaneously pushing said body and said shell into a contact receiving bore for gently enlarging the bore, said first piston means being slidably mounted within said second piston means for retracting said body from said shell while leaving said shell in the bore in a position to receive a contact in the bore;

said second piston means being arranged for retracting said shell from the bore; and locking means for securing a connector body in said adapter means, said locking means including a breech lock, said breech lock being positionally adjustable between a first position in which it may be latched for securing a connector in place in said adapter while said bore enlarging means are installed, and a second position for rendering the connector accessible to the implantation of contacts and contact wires therein.

6. A machine for use in loading contacts into contact receiving bores of a connector body comprising:

adapter means for receiving and retaining a connector body having a contact receiving bore;

bore enlarging means including a body and a shell;

first piston means for supporting said body;

second piston means for supporting said shell;

said first and second piston means cooperating for aligning said body coaxially within said shell and for simultaneously pushing said body and said shell into a contact receiving bore for gently enlarging the bore, said first piston means being slidably mounted within said second piston means for retracting said body from said shell while leaving said shell in the bore in a position to receive a contact in the bore;

said second piston means being arranged for retracting said shell from the bore;

a fixed body;

latching means for latching said first piston and said second piston together, biasing means for connecting said first piston to said fixed body, said biasing means being arranged for urging said first piston in the opposite direction to the direction of travel of said first and second pistons as said pistons push said body and shell into a contact receiving bore, and means responsive to travel of said first piston beyond a limit to release said latching means; and locking means for securing a connector body in said adapter means, said locking means including a breech said breech lock being positionally adjustable between a first position in which it may be latched for securing a connector in place in said adapter while said bore enlarging means are installed, and a second position for rendering the connector accessible to the implantation of contacts and contact wires therein.

7. A semi-automatic contact insertion tool comprising:

adapter means for receiving and holding an electrical connector shell, locking means for securing an electrical connector shell in said adapter means, said connector shell incorporating a bore for receiving and holding an electrical contact and a wire attachable to the contact, combination means, including a shell and a portion having a tapered end within said shell, for resiliently enlarging said bore, first piston means for supporting said portion having a tapered end, second piston means for supporting said shell, said first and second piston means being arranged for pushing said combination means, tapered end first, into the bore to provide gradual enlargement of the bore, said first piston means being slidably mounted within said second piston means for retracting said portion having the tapered end and leaving said shell in the bore in a position permitting insertion of a contact in said shell, and said second piston means being arranged for retracting said shell from the bore to permit the contact to engage and be locked in the bore.

8. The invention as claimed in claim 7, in which said shell of said combination means is shaped as a barrel having open ends and said portion having a tapered end is shaped like a bullet.

9. A semi-automatic contact insertion tool comprising:

adapter means for receiving and holding an electrical connector shell;

locking means for securing an electrical connector shell in said adapter means;

said connector shell incorporating a bore for receiving and holding an electrical contact and a wire attachable to the contact;

combination means, including a shell and a portion having a tapered end within the shell, for resiliently enlarging said bore;

first positioning means for supporting said portion having a tapered end;

second positioning means for supporting said shell, said first and second positioning means being arranged for pushing said combination means, tapered end first, into the bore to provide enlargement of the bore;

said first positioning means being arranged for retracting said portion having the tapered end and leaving said shell in the bore in a position permitting insertion of a contact in said shell;

said second positioning means being arranged for retracting said shell and permitting the contact to engage and be locked in the bore; and said locking means includes a breech lock, said breech lock being adjustable between a first position in which it may be latched for securing the connector in place in said adapter while said combination means are pushed into the bore, and a second position for rendering the connector accessible to the implantation of contacts and contact wires therein.

10. The invention as claimed in claim 7, further comprising a fixed body, latching means for latching said first piston means and said second piston means together, biasing means for connecting said first piston means to said fixed body, said biasing means being arranged for urging said first piston means in the opposite direction to the direction of travel of said first and second piston means as said piston means push said portion having a tapered end and said shell into a contact receiving bore, and means responsive to travel of said first piston means beyond a limit to release said latching means, whereby said first piston means is forced to move in the opposite direction and retract said portion having a tapered end from the bore.

11. A semi-automatic contact insertion tool comprising:

adapter means for receiving and holding an electrical connector shell;

locking means for securing an electrical connector shell in said adapter means;

said connector shell incorporating a bore for receiving and holding an electrical contact and a wire attachable to the contact;

combination means, including a shell and a portion having a tapered end within said shell, for resiliently enlarging said bore;

a first piston for supporting said portion having a tapered end;

a second piston for supporting said shell, said first and second pistons being arranged for pushing said combination means, tapered end first, into the bore to provide gradual enlargement of the bore;

said first piston being slidably mounted within said second piston for retracting said portion having the tapered end and leaving said shell in the bore in a position permitting insertion of a contact in said shell;

said second piston being arranged for retracting said shell from the bore to permit the contact to engage and be locked in the bore; and said locking means includes a breech lock, said breech lock being adjustable between a first position in which it may be latched for securing a connector in place in said adapter while said combination means are pushed into the bore, and a second position for rendering the connector accessible to the implantation of contacts and contact wires therein.

12. A semi-automatic contact insertion tool comprising:

adapter means for receiving and holding an electrical connector shell;

locking means for securing an electrical connector shell in said adapter means;

said connector shell incorporating a bore for receiving and holding an electrical contact and a wire attachable to the contact;

combination means, including a shell and a portion having a tapered end within said shell, for resiliently enlarging said bore;

first piston means for supporting said portion having a tapered end;

a fixed body;

latching means for latching said first piston means and said second means together;

biasing means for connecting said first piston means to said fixed body, said biasing means being arranged for urging said first piston means in the opposite direction to the direction of travel of said first and second piston means as said piston means push said portion having a tapered end and said shell into a contact receiving bore;

means responsive to travel of said first piston means beyond a limit to release said locking means;

second piston means for supporting said shell, said first and second piston means being arranged for pushing said combination means, tapered end first, into the bore to provide gradual enlargement of the bore;

said first piston means being slidably mounted within said second piston means for retracting said portion having the tapered end and leaving said shell in the bore in a position permitting insertion of a contact in said shell;

said second piston means being arranged for retracting said shell to permit the contact to engage and be locked in the bore;

whereby said first piston means is forced to move in the opposite direction and retract said portion having a tapered end from the bore; and said locking means includes a breech lock;

said breech lock being adjustable between a first position in which it may be latched for securing a connector in place in said adapter while said combination means are pushed into the bore; and a second position for rendering in which the connector accessible to the implantation of contacts and contact wires therein.

13. A semi-automatic contact insertion tool comprising a loading unit including a pin and a sleeve, and adapter, said loading unit including means for accepting the adapter, said adapter including means for receiving an electrical connector shell, said connector shell including bores for receiving and holding contacts, breech loading means associated with said loading unit, for permitting a connector shell to be placed in the adapter, said loading unit including a dual piston assembly in which one piston is located within the other, means coupling the dual pistons respectively to the pin and sleeve for moving the pin and sleeve as the pistons are moved, a spring connected to one of said pistons, means releasing said spring when a particular position of the pistons is reached, said spring retracting the one piston and the pin to a stop position, the breech loading means being operable to a position for permitting contacts to be placed in bores in the connector shell to the stop position, and air controlled means for retracting the other piston and the sleeve, causing the shell to receive the contacts in the bores and permitting the connector to be removed from the adapter.

14. The invention as claimed in claim 13, in which the breech loading means includes pivot means for swinging said breech loading means from a first position preventing access to a connector shell to a second position permitting access to bores in a connector shell, said breech loading means being arranged in its first position for retaining a connector in place when the dual pistons move the pin and sleeve into contact with bores in the connector.

* * * * *